United States Patent [19]

Asagao et al.

[11] 4,431,610

[45] Feb. 14, 1984

[54] METHOD OF RECOVERING URANIUM FROM WET PROCESS PHOSPHORIC ACID

[75] Inventors: Soichi Asagao; Shinsuke Nakagawa; Naoki Okada, all of Ube; Seizi Yoshikawa, Yamaguchi, all of Japan

[73] Assignee: Central Glass Company Limited, Ube, Japan

[21] Appl. No.: 351,171

[22] Filed: Feb. 22, 1982

[30] Foreign Application Priority Data

Feb. 23, 1981 [JP] Japan ..... 56-24242
Oct. 13, 1981 [JP] Japan ..... 56-162077

[51] Int. Cl.[3] ..... C01G 56/00

[52] U.S. Cl. ..... 423/12; 423/11; 423/18; 423/320; 423/555

[58] Field of Search ..... 423/11, 12, 18, 170, 423/320, 321 R, 555

[56] References Cited

U.S. PATENT DOCUMENTS 3,632,307 1/1972 van Es et al. ..... 423/320 X
4,311,677 1/1982 Gerunda et al. ..... 423/11 X

FOREIGN PATENT DOCUMENTS 884823 12/1980 Belgium .
55-144419 11/1980 Japan .

*Primary Examiner*—Deborah L. Kyle
*Assistant Examiner*—Matthew A. Thexton
*Attorney, Agent, or Firm*—Fleit, Jacobson, Cohn & Price

[57] ABSTRACT

An economically advantageous method of recovering uranium from a wet process phosphoric acid solution through the steps of making hemihydrate gypsum contact with the acid solution thereby transferring uranium from the acid solution into the gypsum, dispersing the U-containing gypsum separated from the acid solution in water to convert the gypsum to dihydrate accompanied by the transfer of uranium into water, separating the obtained U-containing aqueous solution from the dihydrate gypsum, and adding precipitant such as an inorganic base to the aqueous solution to form a precipitate comprising an insoluble uranium compound. The contact of hemihydrate gypsum with the phosphoric acid solution is preferably preceded by reduction of hexavalent uranium in the acid solution to tetravalent uranium, and can be achieved either by adding hemihydrate gypsum to the acid solution or by converting dihydrate gypsum to hemihydrate within the acid solution preferably preceded by the addition of sulfuric acid.

20 Claims, 1 Drawing Figure

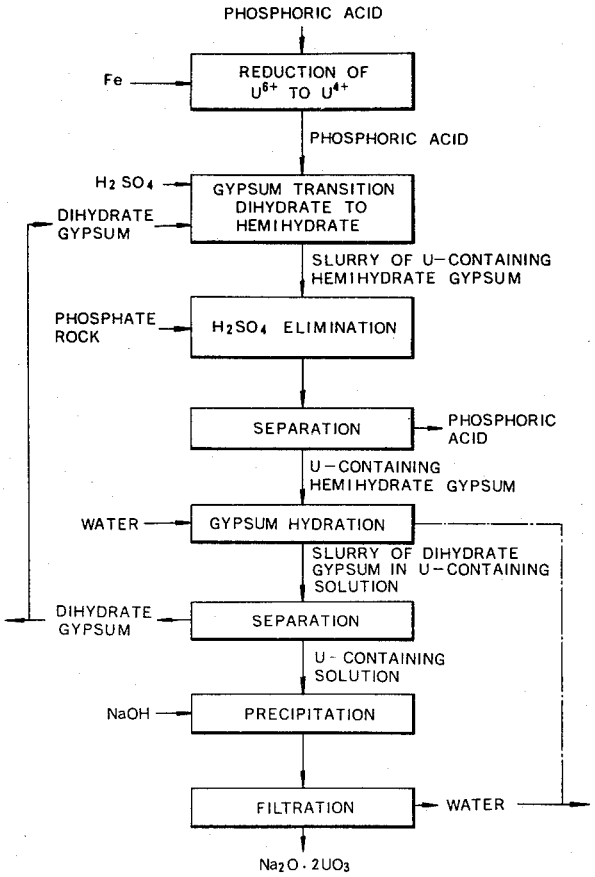

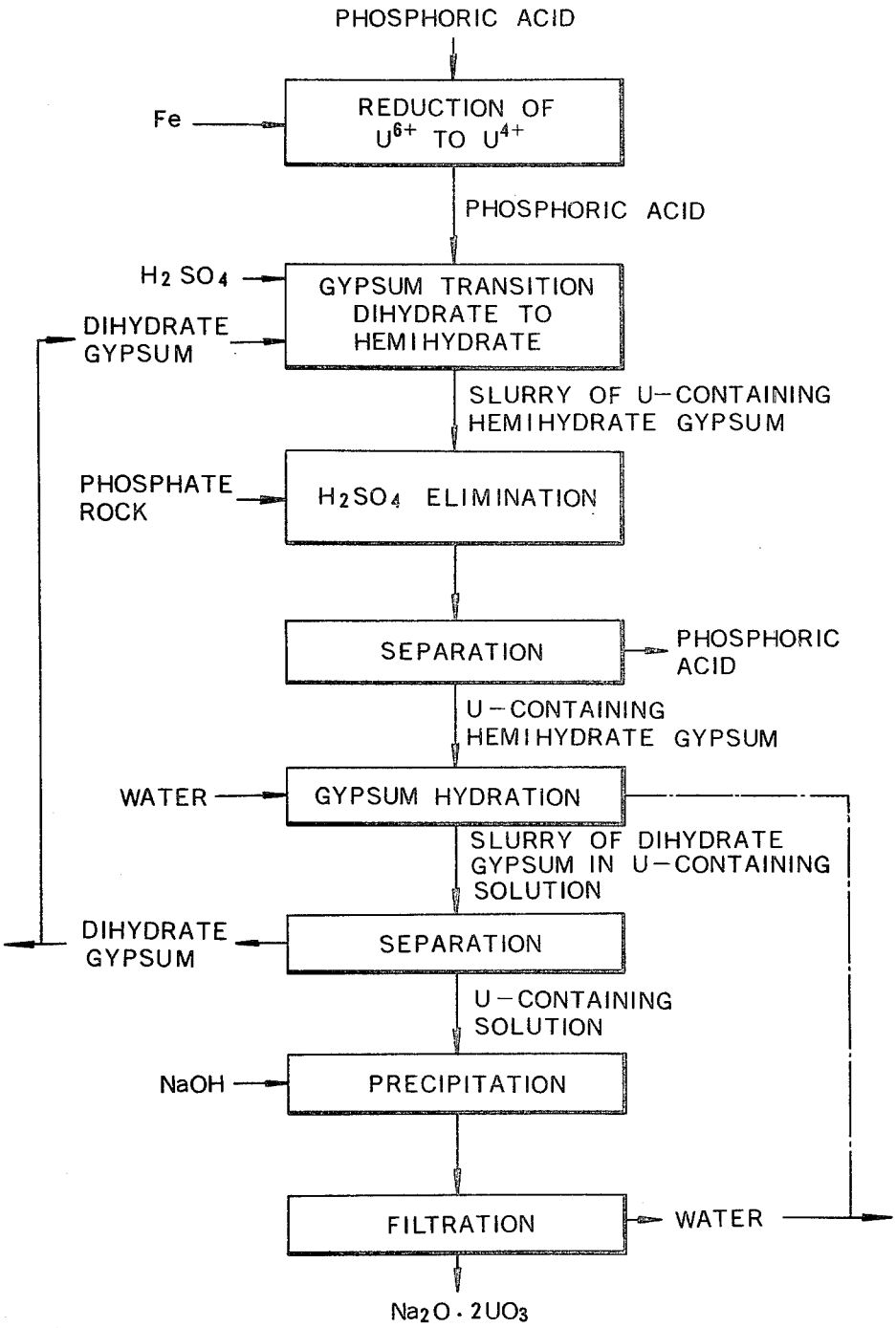
PHOSPHORIC ACID
Fe
REDUCTION OF $U^{6+}$ TO $U^{4+}$
PHOSPHORIC ACID
$H_2SO_4$
DIHYDRATE GYPSUM
GYPSUM TRANSITION DIHYDRATE TO HEMIHYDRATE
SLURRY OF U-CONTAINING HEMIHYDRATE GYPSUM
PHOSPHATE ROCK
$H_2SO_4$ ELIMINATION
SEPARATION
PHOSPHORIC ACID
U-CONTAINING HEMIHYDRATE GYPSUM
WATER
GYPSUM HYDRATION
SLURRY OF DIHYDRATE GYPSUM IN U-CONTAINING SOLUTION
DIHYDRATE GYPSUM
SEPARATION
U-CONTAINING SOLUTION
NaOH
PRECIPITATION
FILTRATION
WATER
$Na_2O \cdot 2UO_3$

METHOD OF RECOVERING URANIUM FROM WET PROCESS PHOSPHORIC ACID

BACKGROUND OF THE INVENTION

This invention relates to a method of recovering uranium from wet process phosphoric acid obtained by acid decomposition of phosphate rock of natural occurrence by utilizing gypsum as a medium for the recovery of uranium.

Phosphate rocks of natural occurrence generally contain about 100–200 ppm of uranium. In the wet process manufacture of phosphoric acid by wet decomposition of phosphate rock with a mixed acid consisting of sulfuric acid and recycled phosphoric acid, most of uranium contained in the phosphate rock transfers into the phosphoric acid solution obtained as the liquid component of a gypsum slurry. Since wet process phosphoric acid is manufactured in an enormous quantity, recovery of uranium from wet process phosphoric acid solution has long been tried although the uranium content in the solution is not so high.

For industrially recovering uranium from wet process phosphoric acid, various kinds of recovering methods such as the solvent extraction method, ion-exchange method, precipitation method and adsorption method have been proposed until now.

Particularly the solvent extraction method has already been industrialized in several countries, but this method is disadvantageous in some respects. Firstly, the cost of equipment becomes high because there is the need of refining the phosphoric acid by a pretreatment in order to prevent formation of sludge at the stage of extraction. Besides, the solvent for the extraction is an expensive one, and therefore the recovery must be carried out by complicated operations in order to avoid the loss of the expensive solvent.

The ion-exchange method also requires a certain pretreatment of the phosphoric acid solution. Furthermore, in this method it is necessary to considerably lower the concentration of the phosphoric acid solution to be introduced into the ion-exchange column from usual concentrations of phosphoric acid produced by the wet process. By reason of such inconveniences this method has not yet widely been industrialized. Neither the precipitation method nor the adsorption method has been put into industrial practice mainly because of expensiveness of the precipitating agent or the adsorbing agent and inevitableness of a considerable loss of the expensive agent.

Japanese Patent Application No. 55(1980)-102409 discloses that hemihydrate gypsum in a phosphoric acid solution exhibits surprisingly different affinities for tetravalent ions and hexavalent ions of uranium and consequentially captures the tetravalent ions with a selectivity factor of nearly 100%, and proposes to enhance the uranium concentration in a wet process phosphoric acid solution by performing the wet process such that hemihydrate gypsum is formed in the presence of an oxidizing agent in the acid solution to render uranium dissolved in the solution entirely hexavalent. However, this Japanese patent application gives no new teaching about the method of recovering uranium from the phosphoric acid solution prepared by the improved process.

Japanese Patent Application Primary Publication No. 55(1980)-144419 proposes to incorporate a solvent extraction process for the recovery of uranium in a so-called hemihydrate-dihydrate type wet process for the manufacture of phosphoric acid, in which process calcium sulfate is intermediately formed as hemihydrate and subsequently converted to dihydrate. The uranium recovering process according to this proposal is inseparable from the process of preparing phosphoric acid and is applicable only to the hemihydrate-dihydrate process. In other words, this proposal cannot be applied to the other types of wet process for the manufacture of phosphoric acid, such as the dihydrate process, anhydride process, hemihydrate process and dihydrate-hemihydrate process. Besides, a uranium-containing solution obtained by the proposed treatment using gypsum as a recovering medium still contains large amounts of $P_2O_5$ and $H_2SO_4$, and therefore the recovery of uranium from this solution must be accomplished by a solvent extraction method under restricted conditions in order to avoid the loss of $P_2O_5$. This solvent extraction method is also disadvantageous in using an expensive solvent for the extraction and in requiring costly apparatus.

SUMMARY OF THE INVENTION

It is an object of the present invention to provide a novel method of recovering uranium from a wet process phosphoric acid solution, which method is industrially practicable regardless of the particulars of the wet process for the preparation of the phosphoric acid solution and is economically advantageous over the known methods for the same purpose.

A method according to the invention for the recovery of uranium from a wet process phosphoric acid solution comprises the steps of (a) making hemihydrate gypsum contact with the phosphoric acid solution thereby transferring uranium dissolved in the phosphoric acid solution into the hemihydrate gypsum, (b) separating the hemihydrate gypsum from the phosphoric acid solution, (c) dispersing the separated hemihydrate gypsum in water thereby hydrating the hemihydrate gypsum to dihydrate gypsum accompanied by the transfer of uranium from the gypsum under hydration into the water, (d) separating a uranium-containing aqueous solution obtained at the step (c) from the dihydrate gypsum, and (e) adding a precipitant to the separated uranium-containing solution to form a precipitate comprising a water insoluble uranium compound.

As will be understood from the above statement, the uranium recovering method according to the invention is totally separate from a wet process for the production of phosphoric acid. Accordingly this method is applicable to the product of every type of wet process for phosphoric acid.

A principal feature of the invention resides in the use of gypsum as a uranium extracting agent and water as a back extraction agent. The aqueous solution obtained through the back extraction of uranium from the hydrated gypsum contains uranium in a high concentration but does not contain obstructive materials such as $P_2O_5$ and $H_2SO_4$, so that uranium can easily and efficiently be recovered from this solution by a precipitation method using an inexpensive precipitant such as an alkali. The operation of the precipitation step is quite simple in marked contrast to the complicated operations in the known solvent extraction methods. By the way, in the uranium recovering method according to the aforementioned Japanese Patent Application Primary Publication NO. 55(1980)-144419 it is impossible to employ a precipitation method of this category without adversely influencing the inseparable process of producing phosphoric acid.

All the steps of the uranium recovering method according to the invention can be accomplished by simple operations without needing expensive materials or costly apparatus, and it is possible to use gypsum obtained as the by-product of the wet process manufacture of the phosphoric acid solution to which the recovering method is applied. Therefore, this uranium recovering method is quite suited to industrial practice.

At the first step of the method according to the invention, hemihydrate gypsum is made to contact with the phosphoric acid solution either by directly adding hemihydrate gypsum to the acid solution or by forming hemihydrate gypsum within the solution. In the latter case, hemihydrate gypsum may be formed by adding dihydrate gypsum to the phosphoric acid solution and then converting the gypsum to hemihydrate by a heat treatment, or alternatively by adding a phosphate rock and sulfuric acid to the phosphoric acid solution and decomposing the phosphate rock at a temperature suited to the formation of hemihydrate gypsum. As a modification of the dihydrate-to-hemihydrate conversion method, it is possible and rather preferable to form hemihydrate gypsum by the sub-steps of adding a suitable amount of sulfuric acid to the phosphoric acid solution, then adding dihydrate gypsum to the mixed acid solution to convert the gypsum to hemihydrate by a heat treatment and thereafter adding a small amount of phosphate rock to the gypsum slurry and maintaining the slurry at a temperature suited to the decomposition of the phosphate rock with formation of hemihydrate gypsum by consumption of sulfuric acid present in the slurry.

BRIEF DESCRIPTION OF THE DRAWING

The single FIGURE is a flow diagram showing a uranium recovering method embodying the present invention.

DESCRIPTION OF THE PREFERRED EMBODIMENTS

In the present invention, of course it is desirable that the concentration of uranium in the wet process phosphoric acid solution as the raw materials is as high as possible. Accordingly it is desirable to use a wet process phosphoric acid solution prepared according to the aforementioned Japanese Patent Application No. 55(1980)-102409, which proposes to render uranium dissolved in the mixed acid used in the wet process entirely hexavalent by using an oxidizer such as $KClO_3$, $NaClO_3$, $H_2O_2$, $KMnO_4$, $HNO_3$, HCl, oxygen gas or air at a stage where hemihydrate gypsum is formed. Of course, gypsum and other solid materials are separated from the phosphoric acid solution to be used in the uranium recovering method according to the invention.

Also it is desirable that the wet process phosphoric acid solution as the raw material is a so-called defluorinated phosphoric acid, which is obtained by removing fluorine from a wet process phosphoric acid solution by a known treatment such as the addition of a source of silica and a source of alkali to the phosphoric acid to fix fluorine dissolved in the acid as an alkali fluorosilicate. In the case of using a commercially available defluorinated phosphoric acid, it is optional to repeat such a defluorinating treatment preparatory to the step (a) of the uranium recovering method. In the method according to the invention, it has been confirmed that the recovery of uranium increases as the content of fluorine in the phosphoric acid solution is lower. As a presumable reason for this fact, the presence of a large quantity of fluorine ions in the phosphoric acid will constitute some obstacle to the substitution reactions between uranium and calcium. In practice, the recovery of uranium by the method of the invention reaches a very high rate when the concentration of fluorine in the phosphoric acid solution is not higher than 0.5%.

Preferably, hexavalent uranium present in the wet process phosphoric acid solution is reduced to tetravalent uranium in advance of the step of making hemihydrate gypsum contact with the acid solution since tetravalent uranium is far more readily be captured by hemihydrate gypsum than hexavalent uranium. The reduction can be achieved either by the addition of a reducing agent such as iron powder to the phosphoric acid solution or by an electrolytic reduction method.

As mentioned hereinbefore, the contact of hemihydrate gypsum with the phosphoric acid solution in the method of the invention can be realized either by makig hemihydrate gypsum directly contact with the acid solution or by forming hemihydrate gypsum within the acid solution by conversion from dihydrate gypsum or by decomposition of phosphate rock. In practice, the selection of a method of performing this step will be made with consideration of the characteristics of the phosphoric acid solution subjected to the recovery of uranium (concentrations of $P_2O_5$, $SO_3$, etc. and the kinds and contents of impurities) and/or the particulars of the wet process phosphoric acid production plant in which the method of the invention is performed. Hereafter, each method for the contact of hemihydrate gypsum with the phosphoric acid solution is described in detail.

(1) Direct Contat of Hemihydrate Gypsum with Phosphoric Acid

In this case either $\alpha$-hemihydrate gypsum or $\beta$-hemihydrate gypsum can be used. Also a mixture of $\alpha$-hemihydrate gypsum and $\beta$-hemihydrate gypsum can be used. Usually it is convenient to add hemihydrate gypsum to the phosphoric acid solution to form a gypsum slurry by well stirring the mixture. Alternatively, the phosphoric acid solution may be passed in a bed packed with hemihydrate gypsum. In either case the phosphoric acid solution and the hemihydrate gypsum in contact with each other must be maintained at a temperature high enough to prevent hydration of hemihydrate gypsum. When the concentration of $P_2O_5$ in the phosphoric acid solution is about 30% it is suitable to perform the contacting operation at a temperature of 80°–100° C., though there is a possibility of employing a lower temperature without resulting in hydration of hemihydrate gypsum depending on the kinds and contents of impurities in the phosphoric acid.

(2) Conversion of Dihydrate Gypsum to Henihydrate

In this case dihydrate gypsum is added to the phosphoric acid solution, and the resultant slurry is maintained at an elevated temperature suited to the transition of the dispersed dihydrate gypsum to hemihydrate gypsum. From an industrial or economical viewpoint it is advantageous to use dihydrate gypsum obtained as the by-product of wet process phosphoric acid, but of course it is also possible to use dihydrate gypsum of any other origin. In a system consisting of high purity phosphoric acid and gypsum, the transition temperature of dihydrate gypsum to hemihydrate gypsum is 80° C.

when the concentration of $P_2O_5$ in the acid is 30%. However, in the case of using a wet process phosphoric acid which contains relatively large amounts of impurities the transition temperature becomes above 80° C. and sometimes exceeds 100° C. On the other hand, the transition temperature lowers as the $P_2O_5$ concentration in the acid increases. In the practice of this method, a suitable temperature is usually in the range from 90° C. to 110° C.

(3) Decomposition of Phosphoric Rock

In this case hemihydrate gypsum is introduced into the phosphoric acid solution by adding suitable quantities of phosphate rock and sulfuric acid to the phosphoric acid solution, and maintaining the reaction system at a temperature suited to decompose the phosphate rock by the mixed acid with formation of hemihydrate gypsum. Therefore, the operation to perform this step is similar to that in the stage of forming hemihydrate gypsum in the so-called hemihydrate-dihydrate process for the manufacture of phosphoric acid.

(4) Conversion of Dihydrate Gypsum to Hemihydrate in Mixed Acid

This method can be taken as a modification of the above described method (2), and the gist of the modification is to effect the transition of dihydrate gypsum to hemihydrate gypsum in a mixed acid prepared by adding sulfuric acid to the phosphoric acid solution subjected to the recovery of uranium. In the mixed acid the condition of the dihydrate-to-hemihydrate transition becomes considerably milder than that in phosphoric acid, so that it becomes practically possible to achieved the transition at a temperature in the range from 85° to 90° C. Sulfuric acid is added to the phosphoric acid solution in such a quantity that the amount of $H_2SO_4$ in the resultant mixed acid is not greater than 25% by weight, and preferably is in the range from 5 to 15% by weight. If the amount of $H_2SO_4$ is very small the effect of using a mixed acid remains insufficient, but it is undesirable that the amount of $H_2SO_4$ exceeds 25% because there is the need of eliminating $H_2SO_4$ from the reaction system after the transition of dihydrate gypsum to hemihydrate by using phosphate rock to form gypsum and, therefore, the use of such a large amount of $H_2SO_4$ makes it necessary to dispose of an inconveniently large quantity of gypsum and to increase the capacity of the apparatus.

Also in this case it is advantageous to use dihydrate gypsum obtained as the by-product of wet process phosphoric acid. It is further advantageous to recycle a portion of dihydrate gypsum formed at the subsequent hydration step of the uranium recovering method according to the invention. In general, the quantity of dihydrate gypsum to be added to the mixed acid is adjusted such that the gypsum concentration in the resultant slurry is in the range from 5 to 40% by weight although a suitable quantity is somewhat variable depending on the composition of the mixed acid. The slurry is maintained at a sufficiently elevated temperature, which is usually in the range from 85° to 90° C., until completion of the transition of the dihydrate gypsum in the slurry to hemihydrate gypsum.

After the transition of the dihydrate gypsum to hemihydrate, the liquid phase of the gypsum slurry is still a mixed acid solution which cannot be sold as phosphoric acid by merely separating the hemihydrate gypsum therefrom. To eliminate sulfuric acid from the liquid phase, a suitable quantity of phosphate rock is added to the hemihydrate gypsum slurry so as to undergo wet decomposition by reacting with sulfuric acid remaining in the slurry with formation of hemihydrate gypsum. Of course the quantity of the phosphate rock is so adjusted as to just balance with the amount of $H_2SO_4$ in the mixed acid solution. During this operation, uranium contained in the added phosphate rock is captured by the hemihydrate gypsum present in the reaction system. The decomposition reaction can be carried out at 85°-90° C. similarly to the preceding conversion of dihydrate gypsum to hemihydrate. By this supplementary step, the liquid phase of the slurry can be modified to a composition acceptable as commercial wet process phosphoric acid.

The flow diagram in the accompanying drawing shows a uranium recovering method according to the invention, in which method the contact of hemihydrate gypsum with the phosphoric acid solution is effected by the above described method (4).

The hemihydrate gypsum made to contact with the wet process phosphoric acid solution by any one of the above described methods (1) to (4) captures most of uranium dissolved in the phosphoric acid solution, so that the concentration of uranium in the hemihydrate gypsum at the end of this step becomes 10 to 5000 ppm. Then the U-containing hemihydrate gypsum is separated from the acid solution by filtrate for instance.

At the next step, the U-containing hemihydrate gypsum is dispersed in water to undergo hydration with a result that, during the transition of the hemihydrate gypsum to dihydrate gypsum, almost the entire quantity of uranium transfers from the gypsum into water, i.e. from the solid phase of the slurry into the liquid phase. This operation is unique to the method according to the invention, and it is an important advantage of using gypsum as the medium for the recovery of uranium that uranium can be extracted from hemihydrate gypsum by a simple hydration operation. If it were necessary to dissolve the U-containing hemihydrate gypsum in an acid such as hydrochloric acid in order to extract uranium from the gypsum, the use of an acid-resistant apparatus and consumption of a large quantity of acid would be needed, and furthermore the separation of uranium from the resultant solution would encounter great difficulty due to the coexistence of large quantities of gypsum and acid in the solution.

The hydration reaction at this step can be carried out at room temperature. Optionally, a small quantity of sulfuric acid, an oxidizer or a hydration promoter may be added to the mixture of the gypsum and water to promote the hydration reaction. The proportion of water to the U-containing hemihydrate gypsum can be varied over a wide range, but consideration should be given to the following tendencies. Although it is possible to obtain an aqueous solution high in the concentration of uranium by using a relatively small amount of water, the loss of uranium by adsorption by the hydrated gypsum becomes considerable when the amount of water is too small. On the other hand, the use of an excessively large amount of water gives an aqueous solution very low in the concentration of uranium, so that the subsequent treatment of the solution for the recovery or uranium from the solution becomes uneconomical. In view of such tendencies, it is suitable that the weight ratio of water to the U-containing hemihydrate gypsum is in the range from 0.1:1 to 20:1. To facilitate mixing of the U-containing hemihydrate gypsum with water and the subsequent filtration of the mixture, it is suitable to use such an amount of water at the water-gypsum mixture takes the form of a ırry containing 5 to 40% by weight of gypsum.

The dihydrate gypsum formed by the hydration oper- ,on contains little uranium. This dihydrate gypsum is ıysically separated from the liquid phase containing anium in dissolved state. (Hereinafter this U-contain- g liquid phase will be called recovery solution.) When e initial step of the uranium recovering method is :rformed by the above described method (2) or (4), it preferable to recycle a portion of the separated dihy- ate gypsum to the initial step. Also it is possible to use e separated dihydrate gypsum in the production of ment.

The recovery solution obtained through the above 'scribed steps is practically free from phosphoric acid, d the concentration of U dissolved in this solution ually ranges from about 10 ppm to thousands of ppm. ranium can easily and economically be taken out of e recovery solution by using a precipitation method. the present invention, it is convenient to use an inor- ınic base such as sodium hydroxide, aqueous ammonia an ammonium salt as a precipitant, but it is also possi- e to use a precipitant of a different type such as a rrous salt or an organic chelate compound. It is imper- issible to devaluate the phosphoric acid solution sub- cted to the recovery of uranium by the addition of any ıfavorably influential chemical agent since the phos- ıoric acid solution must remain as a commercial prod- :t. However, the recovery solution obtained in the ethod according to the invention is completely sepa- te from the phosphoric acid solution and the process producing it. Therefore if desired it is free to add an lsorbent, aggregating agent, surface-active agent and- ır pH adjusting agent to the recovery solution in addi- ɔn to the aforementioned precipitant for the purpose adjusting the properties of this solution and thereby rther facilitating the recovery of uranium. Also it is ɔssible to recycle the recovery solution to the stage of ydrating the U-containing hemihydrate gypsum to ıereby further increase the concentration of uranium the recovery solution.

The following examples illustrate the present inven- ɔn.

EXAMPLE 1

As the source of uranium, 500 g of a wet process ıosphoric acid solution ($P_2O_5$ concentration was 30% y weight, and U concentration was 114 ppm), which as obtained by the decomposition of a phosphate rock roduced in Florida with sulfuric acid, was charged to a polypropylene vessel equipped with a stirrer, and ıe vessel was placed in an oil bath to maintain the acid ɔlution at 90° C. As a preliminary treatment to reduce exavalent uranium ions present in the phosphoric acid ɔlution to tetravalent uranium ions, 1.9 g of iron pow- er was added to the acid solution with stirring.

Then 200 g of β-hemihydrate gypsum was added to ıe phosphoric acid solution, and a resultant slurry was irred for 30 min at 90° C. to cause thorough contact of ıe hemihydrate gypsum particles with the acid solu- on. After that, the slurry was filtered to obtain a hemi- ydrate gypsum cake, which was washed first with hot 'ater and next with acetone and then air-dried. By sing the mother liquor separated from the gypsum, ıother 200 g of β-hemihydrate gypsum was treated in ıe same way, and once more the mother liquor was sed for the same treatment of still another 200 g of -hemihydrate gypsum. By analysis, the contents of uranium in the raw materials and the three batches of β-hemihydrate gypsum after the treatment were as shown in the following Table 1.

TABLE 1

| | Weight (g) | Uranium (ppm) |
|---|---|---|
| Phosphoric acid solution | 500 | 114 |
| β-Hemihydrate gypsum before treatment | 200 × 3 | 0 |
| Treated β-hemihydrate gypsum | | |
| 1st batch | 197 | 61 |
| 2nd batch | 195 | 59 |
| 3rd batch | 198 | 59 |

The three batches of treated β-hemihydrate gypsum were mixed together, and 550 g of this β-hemihydrate gypsum was dispersed in 1000 ml of water and allowed to undergo hydration and resultant transition to dihydrate gypsum at room temperature. Then the gypsum was filtered out and washed with water, and the washings were mixed with the mother liquor to obtain a recovery solution amounting to 1080 ml. By analysis it was confirmed that this recovery solution contained 29.5 ppm of uranium. Accordingly the recovery or uranium at the hydration step was calculated to be 97.1%.

This recovery solution was neutralized with aqueous ammonia so as to raise the pH of the solution from the initial value of about 1 to about 6. This treatment caused precipitation of solid matter which weighed 0.172 g after drying. Ammonium uranate was a constituent of the precipitate, and the content of U in the dried precipitate was 18.5%. Therefore, 99.9% of uranium contained in the recovery solution was recovered by the precipitation treatment.

EXAMPLE 2

In a polypropylene vessel equipped with a stirrer, 1.9 g of iron powder was added to 500 g of the phosphoric acid solution described in Example 1 to reduce hexavalent uranium to tetravalent uranium.

Then 100 g of dihydrate gypsum (by-product of the manufacture of wet process phosphoric acid) was added to the phosphoric acid solution, and a resultant slurry was maintained at 105° C. by using an oil bath and stirred for 3 hr to thereby complete the transition of the entire quantity of the dihydrate gypsum to hemihydrate gypsum. Then the slurry was filtered to obtain a dihydrate gypsum cake, which was washed first with hot water and next with acetone and thereafter air-dried. Table 2 shows the analytical values of uranium contents in the raw materials and the obtained hemihydrate gypsum.

TABLE 2

| | Weight (g) | Uranium (ppm) |
|---|---|---|
| Phosphoric acid solution | 500 | 114 |
| Dihydrate gypsum | 100 | 2 |
| Hemihydrate gypsum | 83 | 655 |

From the numerical values in Table 2, it is understood that 95.0% of uranium contained in the phosphoric acid solution transferred into the hemihydrate gypsum.

At a next step, 25 g of the U-containing hemihydrate gypsum was dispersed in 50 ml of water and allowed to undergo hydration at room temperature, and the hydrated gypsum was filtered out and washed with water. Another 25 g of the hemihydrate gypsum was hydrated in the same way. The mother liquors and the washings of the two batches were mixed together to obtain a recovery solution amounting to 50.8 ml. The concentration of uranium in this recovery solution was 632 ppm, so that the recovery of uranium at the hydration step was calculated to be 98%.

This recovery solution was neutralized with an aqueous solution of sodium hydroxide so as to raise the pH of the solution from the initial value of about 1 up to 5.5 to thereby cause precipitation of solid matter, which weighed 0.191 g after drying. Sodium diuranate was a constituent of this precipitate, and the content of U in the dried precipitate was 16.8%. Therefore, the recovery of uranium at this step was calculated to be 99.9%.

EXAMPLE 3

In a polypropylene vessel equipped with a stirrer, 1.2 g of iron powder was added to 300 g of the phosphoric acid solution described in Example 1 to reduce hexavalent uranium.

Then 30 g of Floridan phosphate rock BPL 76 and 44 g of 56% sulfuric acid were added to the phosphoric acid solution, and the resultant mixture was maintained at 100° C. by using an oil bath and stirred. After the lapse of 2 hr, it was confirmed that the phosphate rock had completely been decomposed with formation of hemihydrate gypsum. The slurry was filtered to obtain a hemihydrate gypsum cake, which was washed first with hot water and next with acetone and thereafter air-dried. The dried hemihydrate gypsum weighed 36 g and contained 126 ppm of uranium. Therefore, the proportion of the quantity of uranium contained in this hemihydrate gypsum to the total quantity of uranium contained in the phosphoric acid solution and the phosphate rock was 12%.

At a next step, 25 g of the U-containing hemihydrate gypsum was dispersed in 50 ml of water at room temperature to hydrate the gypsum. The hydrated gypsum was filtered out and washed with water. The washing water was mixed with the mother liquor to obtain 53 ml of a recovery solution. The concentration of uranium in this recovery solution was 55 ppm, so that the recovery of uranium at the hydration step was calculated to be 93%.

This recovery solution was neutralized with aqueous ammonia so as to raise the pH of the solution from the initial value of about 1 up to 6 to thereby cause precipitation of solid matter, which weighed 0.0192 g after drying. Ammonium uranate was a constituent of the precipitate, and the content of U in the dried precipitate was 15.1%. Therefore, the recovery of uranium at this step was calculated to be 99.5%.

EXAMPLE 4

A mixed acid was prepared by adding 30 g of 98% sulfuric acid to 300 g of wet process phosphoric acid ($P_2O_5$ concentration was 30% by weight, F concentration was 1.9%, U concentration was 100 ppm) obtained by decomposition of a phosphate rock produced in Florida with sulfuric acid. The entire quantity of the mixed acid was charged into a polypropylene vessel equipped with a stirrer, and the vessel was placed in an oil bath to maintain the mixed acid at 87° C. As a preliminary treatment to reduce hexavalent uranium present in the mixed acid to tetravalent uranium, 0.2 g of iron powder was added to the mixed acid with stirring.

Then 40 g of dihydrate gypsum (U concentration was 2 ppm) was added to the mixed acid, and the resultant slurry was maintained at 87° C. for 1 hr with continued stirring to thereby achieve complete transition of the dihydrate gypsum to hemihydrate gypsum. After that 32 g of Floridian phosphate rock BPL 75 ($P_2O_5$ content was 34.4%, U concentration was 100 ppm) was added to the gypsum slurry, and the slurry was maintained at 87° C. with continued stirring for 2 hr. It was confirmed that the phosphate rock was completely decomposed by the mixed acid with formation of hemihydrate gypsum. Then the slurry was filtered to obtain 332 g of phosphoric acid solution, which contained 30.3% of $P_2O_5$ and 5 ppm of U, and a hemihydrate gypsum cake which was washed first with hot water and next with acetone and then air-dried. The dried hemihydrate gypsum weighed 74 g and contained 426 ppm of U. Therefore, the proportion of the quantity of uranium contained in this hemihydrate gypsum to the total quantity of uranium contained in the wet process phosphoric acid used as the starting material and the added phosphate rock was 95%.

At a next step, 60 g of the U-containing hemihydrate gypsum was dispersed in 70 ml of water at room temperature to hydrate the gypsum. The hydrated gypsum was filtered out and washed with water, and the washing water was mixed with the mother liquor to obtain a recovery solution amounting to 72 ml. The concentration of U in this recovery solution was 348 ppm, so that the recovery of U at the hydration step was calculated to be 98%.

This recovery solution was neutralized with an aqueous solution of sodium hydroxide so as to raise the pH of the solution from the initial value of about 1 up to 5.5 to thereby cause precipitation of solid matter, which weighed 0.167 g after drying. Sodium diuranate was a constituent of the precipitate, and the content of U in the dried precipitate was 15.0%. Therefore, the recovery of uranium at this step was 99.9% and the total recovery of uranium by this recovering process was calculated to be 93% ($0.95 \times 0.98 \times 0.999$).

EXAMPLE 5

A mixed acid was prepared by adding 30 g of 98% sulfuric acid to 300 g of a so-called defluorinated phosphoric acid ($P_2O_5$ concentration was 30% by weight, F concentration was 0.5%, U concentration was 100 ppm) obtained by subjecting the wet process phosphoric acid used in Example 4 to a defluorination treatment. The entire quantity of the mixed acid was charged into a polypropylene vessel equipped with a stirrer, and 0.2 g of iron powder was added to the mixed acid for the reduction of hexavalent uranium present in the mixed acid.

By using the thus prepared mixed acid, the transition of 40 g of dihydrate gypsum to hemihydrate gypsum and the decomposition of 32 g of the Floridan phosphate rock described in Example 4 were carried out by the same procedure and under the same conditions. As the result, 330 g of a phosphoric acid solution and 75 g (after washing and drying) of hemihydrate gypsum were obtained. The phosphoric acid solution contained 30.5% of $P_2O_5$ and 3 ppm of U, and the hemihydrate gypsum contained 429 ppm of U. Therefore, the recovery of uranium at this stage was 97%.

Then, 60 g of the U-containing hemihydrate gypsum was hydrated by dispersing it in 70 ml of water at room temperature. The hydrated gypsum was filtered out and washed with water, and the washing water was mixed with the mother liquor to obtain 72 ml of a recovery solution. The concentration of U in this recovery solution was 350 ppm, so that the recovery of U at the hydration step was 98%.

This recovry solution was neutralized with aqueous ammonia so as to raise the pH of the solution from the initial value of about 1 up to 6 to thereby cause precipitation of solid matter, which weighed 0.136 g after drying. Ammonium uranate was a constituent of the precipitate, and the content of U in the precipitate was 18.5%. Therefore, the recovery of uranium at this step was 99.9%, and the total recovery of uranium by this recovering process was calculated to be 95% ($0.97 \times 0.98 \times 0.999$).

We claim:

1. A method of recovering uranium from a wet process phosphoric acid solution, comprising the steps of:

(a) adding hemihydrate gypsum to the wet process phosphoric acid solution at a temperature high enough to prevent hydration of the hemihydrate gypsum;

(b) separating the hemihydrate gypsum from the phosphoric acid solution;

(c) washing the separated hemihydrate gypsum to remove substantially all of the phosphoric acid solution therefrom;

(d) dispersing the separted hemihydrate gypsum in water thereby hydrating the hemihydrate gypsum to dihydrate gypsum accompanied by the transfer of uranium from the gypsum under hydration into the water;

(e) separating a uranium-containing aqueous solution obtained at the step (d) from the dihydrate system; and (f) adding a precipitant to the separated uranium-containing solution to form a precipitate which comprises a water insoluble uranium compound.

2. A method according to claim 1, further comprising a preliminary step of reducing hexavalent uranium present in the wet process phosphoric acid solution to tetravalent uranium prior to the step (a).

3. A method according to claim 2, wherein metallic iron is added to the phosphoric acid solution at the preliminary step.

4. A method according to claim 1, wherein the weight ratio of the water to the hemihydrate gypsum at the step (c) is in the range from 0.1:1 to 20:1.

5. A method according to claim 1, wherein said precipitant is an inorganic base.

6. A method according to claim 5, wherein said precipitant is selected from the group consisting of sodium hydroxide and ammonia.

7. A method according to claim 1, wherein said precipitant is a ferrous salt.

8. A method according to claim 1, wherein said precipitant is an organic chelate compound.

9. A method according to claim 1, wherein the wet process phosphoric acid solution is a defluorinated phosphoric acid solution in which the content of fluorine is not higher than 0.5%.

10. A method of recovering uranium from a wet process phosphoric acid solution comprising the steps of:

(a) passing the wet process phosphoric acid solution through a layer of hemihyrate gypsum at a temperature high enough to prevent hydration of the hemihydrate gypsum thereby transferring uranium dissolved in the phosphoric acid solution into the hemihydrate gypsum;

(b) separating the hemihydrate gypsum from the phosphoric acid solution;

(c) washing the separated hemihydrate gypsum to remove substantially all of the phosphoric acid solution therefrom;

(d) dispersing the separated hemihydrate gymsum in water thereby hydrating the hemihydrate gypsum to dihydrate gypsum accompanied by the transfer of uranium from the gypsum under hydration into the water;

(e) separating a uranium-containing aqueous solution obtained at the step (d) from the hydrate system; and (f) adding a precipitant to the separated uranium-containing solution to form a precipitate which comprises a water insoluble uranium compound.

11. A method according to claim 10, further comprising a preliminary step of reducing hexavalent uranium present in the wet process phosphoric acid solution to tetravalent uranium prior to the step (a).

12. A method according to claim 10, wherein the wet process phosphoric acid solution is a defluorinated phosphoric acid solution in which the content of fluorine is not higher than 0.5%.

13. A method of recovering uranium from a wet process phosphoric acid solution comprising the steps of:

(a) dispersing dihydrate gypsum in the phosphoric acid solution and maintaining a resultant slurry at an elevated temperature suited to the transition of dihydrate gypsum to hemihydrate gypsum;

(b) separating the hemihydrate gypsum from the phosphoric acid solution;

(c) washing the separated hemihydrate gypsum to remove substantially all of the phosphoric acid solution therefrom;

(d) dispersing the separated hemihydrate gypsum in water thereby hydrating the hemihydrate gypsum to dihydrate gypsum accompanied by the transfer of uranium from the gypsum under hydration into the water;

(e) separating a uranium-containing aqueous solution obtained at the step (d) from the dihydrate system; and (f) adding a precipitant to the separated uranium-containing solution to form a precipitate which comprises a water insoluble uranium compound.

14. A method according to claim 13, further comprising a preliminary step of reducing hexavalent uranium present in the wet process phosphoric acid solution to tetravalent uranium prior to the step (a).

15. A method according to claim 13, wherein the wet process phosphoric acid solution is a defluorinated phosphoric acid solution in which the content of fluorine is not higher than 0.5%.

16. A method according to claim 13, wherein the step (a) comprises the sub-steps of (i) adding sulfuric acid to the phosphoric acid solution so as to prepare a mixed acid solution in which the amount of $H_2SO_4$ is not greater than 25% by weight, (ii) dispersing dihydrate gypsum in said mixed acid solution and maintaining a resultant slurry at an elevated temperature suited to the transition of dihydrate gypsum to hemihydrate gypsum, and (iii) adding a phosphate rock to the slurry after completion of the sub-step (ii) and maintaining the resultant mixture at an elevated temperature suited to acid decomposition of the phosphate rock with formation of hemihydrate gypsum, the quantity of the phosphate rock being so adjusted as to consume the entire quantity of $H_2SO_4$ present in the mixture for the decomposition of the phosphate rock with formation of hemihydrate gypsum.

17. A method according to claim 16, wherein the amount of $H_2SO_4$ in the mixed acid solution prepared at the sub-step (i) is in the range from 5 to 15% by weight.

18. A method according to claim 16, wherein said temperature at the sub-step (ii) is in the range from 85° to 90° C.

19. A method according to claim 16, wherein the quantity of dihydrate gypsum used at the sub-step (ii) is such that the amount of gypsum in said slurry is in the range from 5 to 40% by weight.

20. A method according to claim 16, wherein a portion of the dihydrate gypsum separated at the step (d) is recycled to the sub-step (ii) of the step (a).

* * * * *